United States Patent [19]

Sask

[11] Patent Number: 4,898,236

[45] Date of Patent: Feb. 6, 1990

[54] DRILL STEM TESTING SYSTEM

[75] Inventor: David Sask, Calgary, Canada

[73] Assignee: Downhole Systems Technology Canada, Calgary, Canada

[21] Appl. No.: 22,128

[22] Filed: Mar. 5, 1987

[30] Foreign Application Priority Data

Mar. 7, 1986 [CA] Canada ..... 503613

[51] Int. Cl.[4] ..... E21B 49/08

[52] U.S. Cl. ..... 166/65.1; 166/106; 166/186; 166/187; 166/250; 166/264

[58] Field of Search ..... 166/65.1, 264, 250, 166/106, 113, 166, 169, 186, 187, 191, 100; 73/155, 152

[56] References Cited

U.S. PATENT DOCUMENTS

| | | | |
|---|---|---|---|
| 2,859,828 | 11/1958 | Williams | 166/100 |
| 3,430,181 | 2/1969 | Urbanosky | 166/100 X |
| 3,439,740 | 4/1969 | Conover | 166/250 |
| 3,577,782 | 5/1971 | Aitken | 73/155 |
| 3,782,191 | 1/1974 | Whitten | 166/100 X |
| 3,831,443 | 8/1974 | Planche | 73/152 |
| 4,345,648 | 8/1982 | Kuus | 166/106 |
| 4,434,653 | 3/1984 | Montgomery | 166/100 X |
| 4,535,843 | 8/1985 | Jageler | 166/65.1 X |
| 4,541,481 | 9/1985 | Lancaster | 166/65.1 |
| 4,573,532 | 3/1986 | Blake | 166/264 |

FOREIGN PATENT DOCUMENTS

| | | | |
|---|---|---|---|
| 622971 | 9/1978 | U.S.S.R. | 166/100 |

*Primary Examiner*—Hoang C. Dang

*Attorney, Agent, or Firm*—Sim & McBurney

[57] ABSTRACT

A drill stem testing system which does not require rotation or axial displacement of an associated drill string to actuate valves and pumps is described. The system includes a drill stem housing constructed in a number of sections which are interconnected with screw-type connections. The housing contains test-related devices such as a pump for inflating packers with wellbore fluids to isolate a test region, a packer deflation valve for exhausting fluids from the packers when testing is complete, a test flow valve for introducing wellbore test flows into the housing, and a pressure equalization valve for placing the test region in communications with external wellbore regions prior to packer deflation. Each of these devices is adapted for electric actuation and contacts an internal power line extending centrally through the interior of the housing. The power line is constructed in line segments which mate with one another when their associated drill stem housing sections are joined to provide a continuous power flow path. An external power line is extended from the surface through a supporting drill string to engage the internal power line. Power switching devices permit an operator to apply power selectively to each of the test-related devices to effect a testing procedure.

4 Claims, 6 Drawing Sheets

DRILL STEM TESTING SYSTEM

FIELD OF THE INVENTION

The invention relates to drill stem testing systems for testing fluids in subsurface regions surrounding a wellbore, and more specifically to the manner in which flow control valves and other test-related devices are operated in such a system.

DESCRIPTION OF THE PRIOR ART

A drill stem testing system is commonly used in connection with gas and oil well drilling where such a system is supported from the end of a drill string, adjacent a subsurface region of interest. The primary purpose of such a testing system is to trap a sample of fluid from subsurface regions to permit subsequent analysis for the presence of hydrocarbons characteristic of gas or oil reserves and to gather in situ pressure and flow rate data while test flows are introduced into the system in a controlled fashion. The sample retrieved on extraction of the drill stem system provides information concerning the nature of formation fluids while pressure and flow rate data permit an estimation of the ability to extract such formation fluids from the subsurface region.

Drill stem test systems commonly have a multi-section housing which contains or supports a number of test-related devices. The housing sections are formed with internal conduits which, when the housing sections are assembled, co-operate to define a network of fluid flow paths required for testing procedure. The housing sections are assembled in the wellbore and then lowered on the end of drill string to the desired test region. Inflatable (or otherwise expandable) packers carried by certain of the housing sections engage the wellbore to isolate a test region. A single packer may be provided if only the bottom of the wellbore is to be tested, but it is common practice to provide a pair of packers which permit a test region intermediate of the top and bottom of the wellbore to be isolated. A pump mounted in the interior of the drill stem housing often serves to pump wellbore drill fluid (commonly referred to as "mud") into the packers for inflation. Once the packers are set, a test flow valve is actuated to introduce a flow of fluid from the test region into one of the channels formed in the drill stem housing. Pressure and temperature sensors monitor wellbore pressure and fluid temperatures during the introduction of test flows, and normally record the relevant data mechanically for retrieval and analysis upon removal of the drill stem testing system. After testing and prior to deflation of the packers, a pressure equalization valve is actuated to place the test region in communication with adjoining isolated wellbore regions through another channel in the drill stem housing. In systems involving inflatable packers, a deflate valve is provided for discharging mud from the packers back into the wellbore. The drill stem system is then retrieved to permit review of the recorded pressure and temperature data and analysis of test fluids trapped in the housing.

Drill stem tests may be performed at depths of 20,000 feet, and mechanisms must be provided to permit test-related devices to be operated from the surface. Such mechanisms must permit selective actuation, for example, of a packer inflation pump or alternative packer expansion means, a test flow valve, a pressure equalization valve, and a packer deflation valve, in order to permit a specific test procedure to be properly implemented. Such devices are presently operated by displacement of the supporting drill string at the surface, either by rotation, axial displacement, or a combination of such motions. The particular order and extent of drill string rotation or axial displacement is mechanically translated into actuation of a particular device. It is common practice to operate the pump used to inflate packers by axial displacement or rotation of the associated drill string, such motion being transformed into a pumping action. Because of the typical length of the drill string used to support a drill stem testing system, displacement of the drill string at the surface does not reliably actuate the test-related devices. Although drill pipe is commonly constructed of steel sections which are comparatively rigid on a section-by-section basis, a great length of drill pipe cannot for practical purposes be regarded as a rigid body. The effect of rotation or axial displacement at the surface may be dissipated along the drill string and may not be transmitted beyond at a point where the drill string binds with the wellbore. Since there is very often no indication that a valve or other test device has failed to actuate, such drill stem systems are often removed from a wellbore without completing a test procedure, and the entire testing procedure including re-installation of the drill string and test system in the wellbore, a very time-consuming process, must be repeated.

BRIEF SUMMARY OF THE INVENTION

In one aspect, the invention provides a drill stem testing system for use in testing fluids in subsurface regions surrounding a wellbore. The drill stem testing system has an elongate housing insertable into the wellbore and channels formed in the housing for receiving and directing fluids through the interior of the housing. The housing contains certain test-related devices including at least one valve for regulating the flow of fluids through the channels, such a down hole flow valve, each of which is adapted to be electrically actuated. Power line means extend through the interior of the housing to transmitting electric power through housing to the test-related devices, and power switching means operable from the surface above the wellbore permit an operator to apply power selectively to each of the test-related devices.

The drill stem housing will typically be constructed in a multiplicity of housing sections adapted to be joined axially to one another. To accommodate such an arrangement, the power line means preferably comprises a multiplicity of power line segments, each power line segment being associated with and adapted to convey electric power through at least one of the housing sections. Each such power line segment has electrical junction means for transferring electric power to complementary electrical junction means associated with the power line segment contained in any adjacent housing section. The electrical junction means are preferably adapted to mate with the complementary electrical junction means when the adjacent housing sections are joined so that electric power can be transmitted continuously between the adjacent housing sections.

In other aspects, the invention provides electrically operable valve mechanisms which can conveniently be used in such a drill stem testing system, and an arrangement for coupling power from the surface to the drill stem testing system. Other inventive aspects of the present development will be described below in connection with a preferred embodiment of a drill stem testing system.

DESCRIPTION OF THE DRAWINGS

The invention will be better understood with references to drawings illustrating a preferred embodiment in which.

DESCRIPTION OF PREFERRED EMBODIMENT

Figure 1:
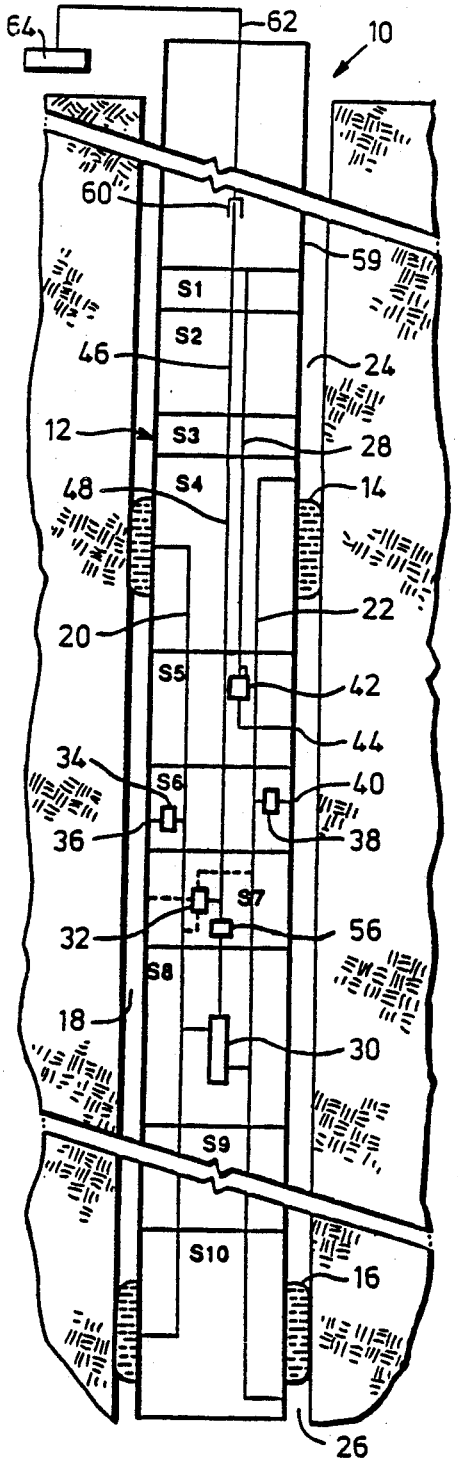
FIG. 1 diagrammatically illustrates a drill stem testing system in situ, and schematically indicates the various fluid and power flow paths associated with the system.

FIG. 1 schematically illustrates a drill stem testing system 10 positioned in a wellbore. The diameter of the system is about 5 inches and the height about 35 feet. The system 10 might be located at a depth of several thousand feet below the surface surrounding the wellbore, suspended from a drill string. It will accordingly be appreciated that such a system cannot be readily illustrated in true proportion, and that FIG. 1 in no way reflects the actual dimensions of such a system.

The drill stem testing system 10 has a generally cylindrical steel housing 12. The housing is constructed in a multiplicity of sections which have been designated with reference numerals S1–S10 in FIG. 1, some of which are simply spacers. These housing sections are joined axially by means of conventional screw fit connections formed at their opposing ends. The various housing sections are formed with internal channels (drilled or otherwise machined in the walls of the housing) which define a number of continuous flow paths when the various sections are joined. Sections S4 and S10 carry inflatable packers 14, 16 (of generally annular construction encircling the exterior of the housing though not apparent in FIG. 1) which have been inflated with drill mud to isolate a wellbore test region 18. The interconnection of the housing sections, the provision of continuous fluid flow paths and the mounting of the packers are all conventional and well known in the art. As well, the drill stem testing system 10 contains such standard components as hydraulic jars, a safety joint for releasing the drill stem assembly above the packer 14 in the event that the packers cannot be dislodged from the wellbore, and a reverse circulation subassembly.

Three basic flow channels will be apparent in FIG. 1. These include a high pressure channel 20 which directs drilling mud under pressure into the packers 14, 16 for inflation. A pressure equalization channel 22 places upper and lower bore regions 24, 26 (otherwise isolated by the packers 14, 16 when inflated) in continuous communication for equalization of pressure between the regions. The pressure equalization channel 22 also places the upper and lower wellbore regions 24, 26 in communication with the test region 18, but fluid flows to and from the test region 18 are gated in a manner described below. A test flow channel 28 extends centrally through the interior of the housing 12 (about a central power line described more fully below), and serves to direct sample fluid into the interior of the housing 12 and towards the surface. The high pressure channel 20 is fed by a pump 30 which has an inlet that receives wellbore mud from the pressure equalizing channel. Conventional pressure and temperature sensors 32 in housing section S7 detect temperature and pressure in the test region 18 for purposes of gathering relevant test data, but also detect pressure in the high pressure channel 20 and the pressure equalization channel 22 for purposes of operating the pump 30 as will be described more fully below.

The drill stem testing system 10 includes three primary flow valves. A packer deflation valve 34 regulates the discharge of drilling fluid from the high pressure channel 20 and the packers 14, 16 through a discharge port 36 formed in the exterior of the housing 12 between the packers 14, 16. A pressure equalizing valve 38 regulates fluid flows between the pressure equalizing line 22 and a port 40 formed in the exterior of the housing 12 between packers 14, 16, and consequently regulates the communication of pressure between the test region 18 and the upper and lower wellbore regions 24, 26. A test flow valve 42 regulates fluid flows from the test region 18 from an test flow inlet port 44, formed in the exterior of the housing 12 intermediate of the packers 14, 16, and the test flow channel 28. Each of the valves is electrically operable: each involves a valve member movable between open and closed positions to regulate fluid flows, and a solenoid which serves to displace the valve member. The test flow valve 42, however, is constructed as a pair of valves, one having a solenoid-actuated valve member which regulates the application of pressure to the other valve for gating of fluid flows.

An internal power line 46, constructed in a multiplicity of segments joined by mating electrical connectors, extends through the interior of the drill stem housing 12. The general relationship between the power line 46 and the various test-related devices is apparent from FIG. 1 and further detail is provided in the schematic representation of FIG. 2. One power line segment 48, which extends through the drill stem housing section S4, is specifically indicated in FIG. 2. The power line segment 48 which is typical (except for a lowermost segment which electrically contacts the pump 32 and does not transfer power further) is terminated at upper and lower ends with electrical connectors adapted to accommodate and connect seven conductors of the power line segment 48 with seven corresponding conductors in an adjacent power line segment 50. The conductors present in the segment 48 being identified by reference characters C1–C7 in FIG. 2; these have also been identified in FIG. 3 where they are shown extensively fragmented. In FIG. 3, an uppermost connector 50 associated with the segment 48 is shown in mating relationship with a lowermost complementary connector 52 of the adjacent housing section S3, forming a junction that permits power and data flow between the adjacent sections S3, S4. The connector 50 has seven conductive contact rings, one such ring R1 specifically indicated in FIG. 3. The complementary connector 52 has seven resilient contact prongs of different length in a circular arrangement (only one prong P1 illustrated for the sake of clarity). These prongs engage the rings when a male section 53 of the connector 50 is engaged with a female section 54 of the connector 52 during connection of the housing sections S3, S4. This is a conventional electrical junction whose ring contacts accommodate relative rotation of the two associated junction members, and which accordingly accommodates screw fitting of housing sections.

The conductor C1 in co-operation with corresponding conductors in the other drill stem sections is used to transmit electric power to the housing section S7. The housing section S7 contains not only the pressure and temperature sensors 32, but also a power switching unit 56 which contains a number of solid state relays (not illustrated) selected to operate at temperatures of at least 250 degrees F. which may commonly occur in a drill stem testing system. The manner in which power is distributed from the switching unit 56 to the various test-related devices will be apparent from the schematic representation of electrical flow paths in FIG. 2. The four conductors C2–C5 in co-operation with corresponding conductors in the other drill stem sections serve as power paths for delivering power from the switching unit 56 to test devices located in other housing sections and are coupled respectively to the test flow valve 42, the deflation valve 34, the equalizing valve 38, and the pump 30. Accordingly, the switching unit 56 can be made to selectively actuate any one of the four test-related devices by applying power to the appropriate one of the conductors C2–C5. The conductor C6 in co-operation with corresponding conductors in the other drill stem sections serves a data line for transmitting control signals from the surface to the switching unit 56 to instruct the switching unit 56 to actuate a particular test-related device. The remaining conductor C7 serves as a data line for transmitting data from the sensors 32 to the surface. The drill stem housing 12 and the supporting drill string serves as a ground line.

Figure 2:
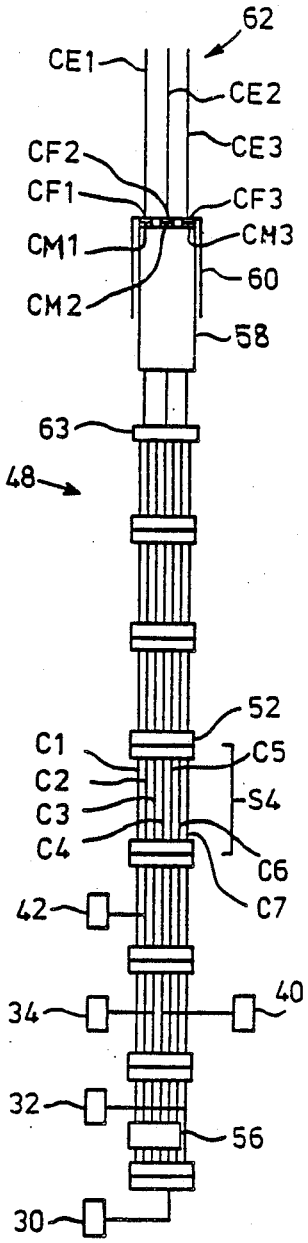
FIG. 2 diagrammatically illustrates the power flow paths and their connection to test-related devices in greater detail.
Figure 3:
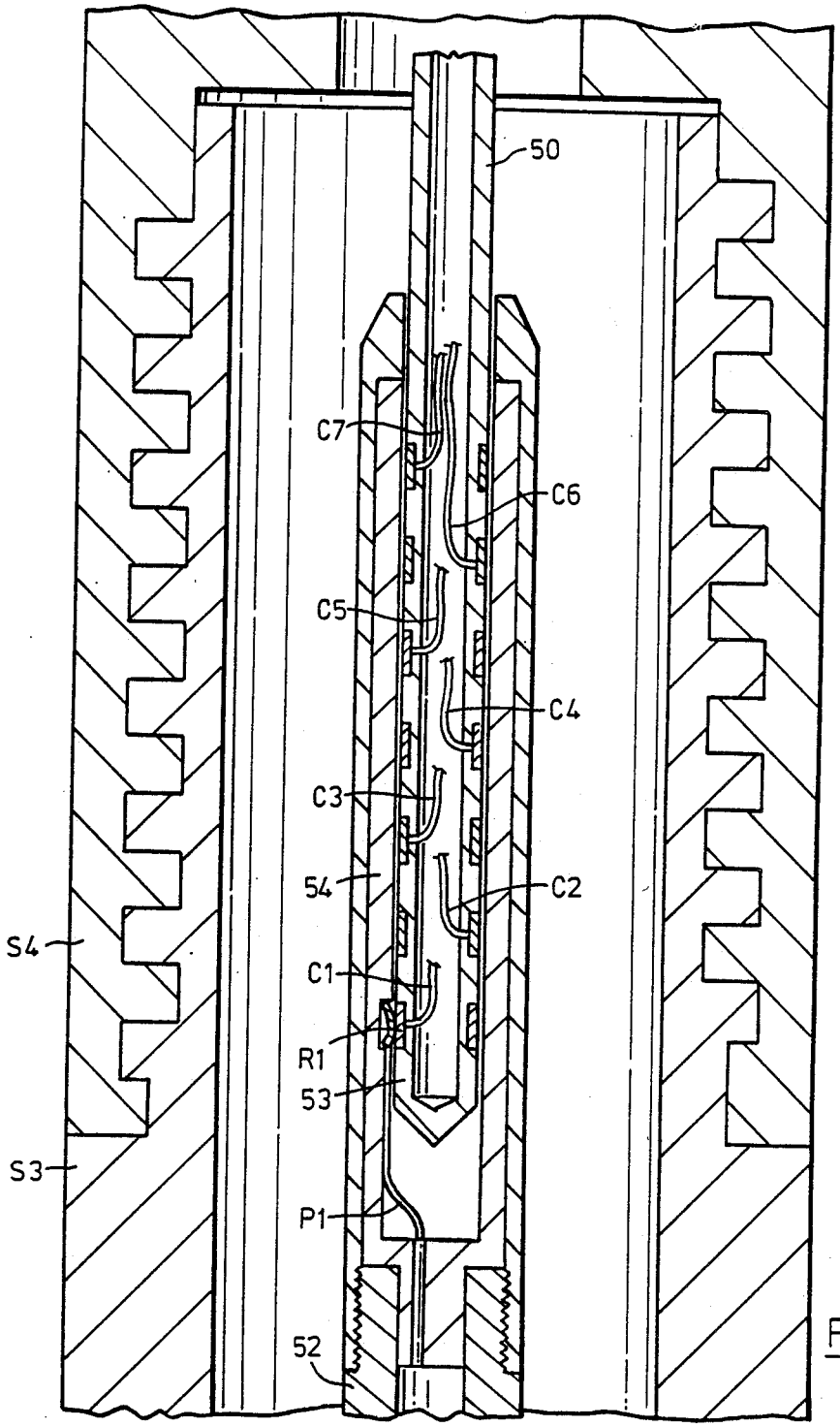
FIG. 3 is a sectional view of the electrical junction formed between two sections of the drill stem testing system.

As will be apparent from FIGS. 1 and 2, the uppermost housing section S1 has a male connector 58 (having three contacts CM1–CM3 illustrated schematically in FIG. 2), which extends upwardly into the interior of a lower drill string section 59. The male connector 58 is adapted to receive a conventional weighted female overshot connector 60 having three complementary contacts CF1–CF3, which can be lowered through the interior of the drill string section 59 on an external power conduction line 62 to mate with the male connector 58. The external power conduction line 62 has only three conductors designated CE1–CE3 in FIG. 2. The conductor CE1 serves to transfer power; the conductor CE2, switching unit control signals; the conductor CE3, data signals from the sensors 32. These power and data signals are transferred to or from the conduction paths of the power line 46 containing conductors C1, C6 and C7, respectively, by an electrical junction 63. A computer 64 at the surface is interfaced with the external power conduction line 62 to permit an operator to selectively actuate each of the principal test system apparatus with signals applied to the conductor CE2 and to receive sensor signals from the conductor CE3 for analysis. The conductors associated with the external power conduction line 62 should be of large diameter to reduce transmission losses which can be considerable over several thousand feet.

As mentioned above, the power line 46 serves as a data line for transmitting data through the interior of the drill stem housing 12 and the external power conduction line 62 co-operates with the internal power line 46 to transmit such data to the surface. As schematically indicated in FIG. 1, the sensors 32 communicate with the high pressure channel 20, the equalizing channel 22 and the test region 18 to sense pressure and temperature. This data is transmitted to the surface so that the testing procedure is continuously monitored and so that the pump 30 may be appropriately actuated to keep the packers 14, 16 properly inflated. Prior drill stem systems have normally been operated under the assumption that an associated pump will have inflated packers after some predetermined pumping time has expired, which may not in fact be the case. In the present system 10, transmission of information regarding the pressure in the high pressure channel 20 and the equalizing channel 22 permits an operator to detect when sufficient pressure has accumulated in the high pressure channel 20 for packers inflation relative to ambient pressure (as in the equalizing channel 22), and the pump 30 is automatically actuated from the surface by the computer 64 to maintain a predetermined pressure differential between the high pressure and equalizing channels with a view to keeping the packers 14, 16 properly inflated. This is regarded as a very advantageous and inventive aspect of the present invention.

The number of distinct power line segments comprised by the power line 46 can be reduced if desired by running a single power line segment through several housing sections. This is particularly convenient in connection with the uppermost housing sections S1–S3 where a single removable power line segment can be extended from the uppermost segment S1 to engage the electrical junction means associated with the upper end of the housing section S4. Such a removable power line segment can be inserted into through the three housing sections S1–S3 when all housing sections have been assembled in the drill bore. Modification of the power line 46 in the required manner will apparent to those skilled in the art, and such an arrangement is regarded as being within the ambit of the present invention and the scope of the appended claims.

The drill stem testing system 10 includes a number of components whose construction is regarded as inventive. These components facilitate the construction of a drill stem testing system whose various test-related devices (primarily valves) can be operated entirely from the surface, without rotation or axial displacement of the associated drill string, and will be described in detail below.

Figure 4:
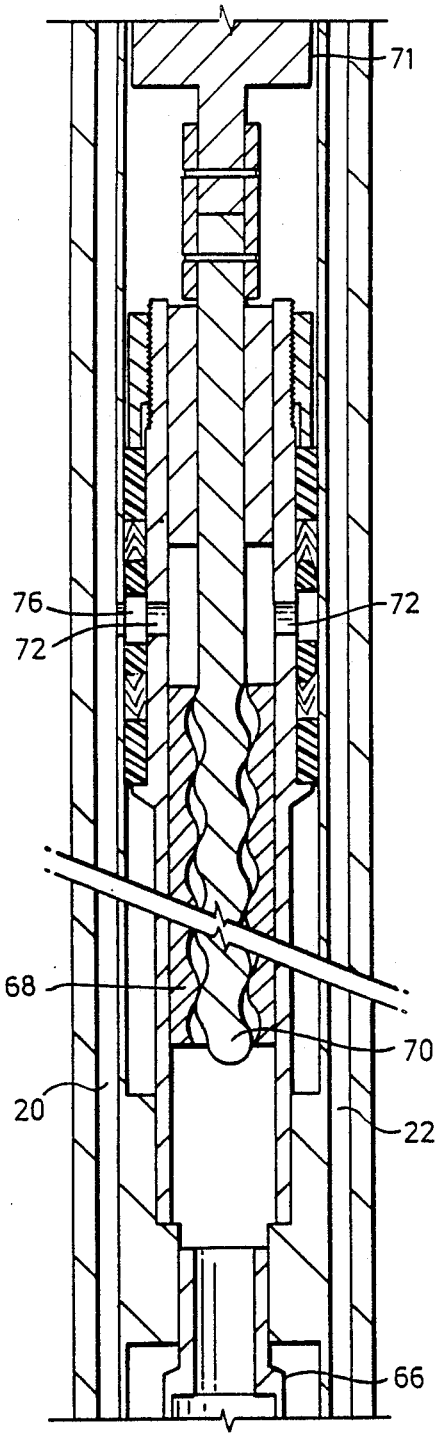
FIGS. 4 and 5 are sectional views in a vertical plane of a pump section of the drill stem testing system.
Figure 5:
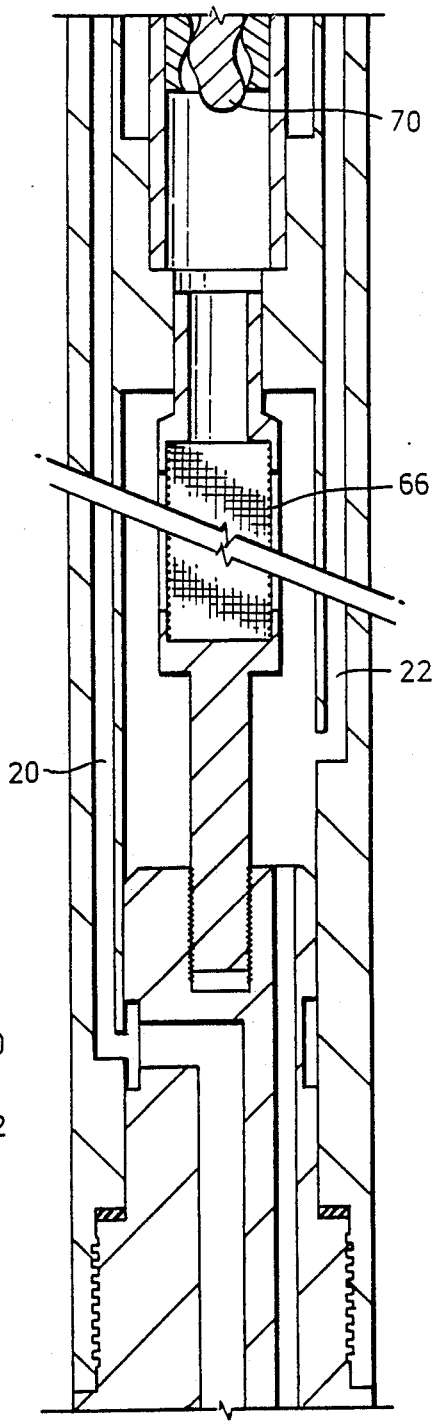

The pumping section associated with the drill stem testing system 10 is illustrated in FIGS. 4 and 5 which are extensively fragmented in view of the dimensions of the pumping section. It should be noted that FIG. 4 illustrates an upper fragment of the pumping section, and FIG. 5 a lower fragment. The views of FIGS. 4 and 5 overlap somewhat in order to facilitate viewer orientation, as do views illustrating other mechanisms associated with the drill stem testing system 10.

The pump 30 is of a progressive cavity type which is singularly advantageous in this drill stem testing system. A cylindrical screen 66 serves to remove large chunks of material from wellbore mud being introduced to the pump unit from the equalizing channel 22. The pump has a stator 68 formed of an elastomeric material encircled with steel, and a stainless steel rotor 70 which is rotated within the stator 68 by an electric motor 71. The rotor and stator assembly receive mud filtered by the screen 66 and exhausts mud under pressure through passages 72, 74 communicating with the high pressure channel 20 through a surrounding annular chamber 76. The high pressure channel 20 conveys this mud which is subject to relatively high pressure upwardly and downwardly to the pair of packers 14, 16.

Figure 6:
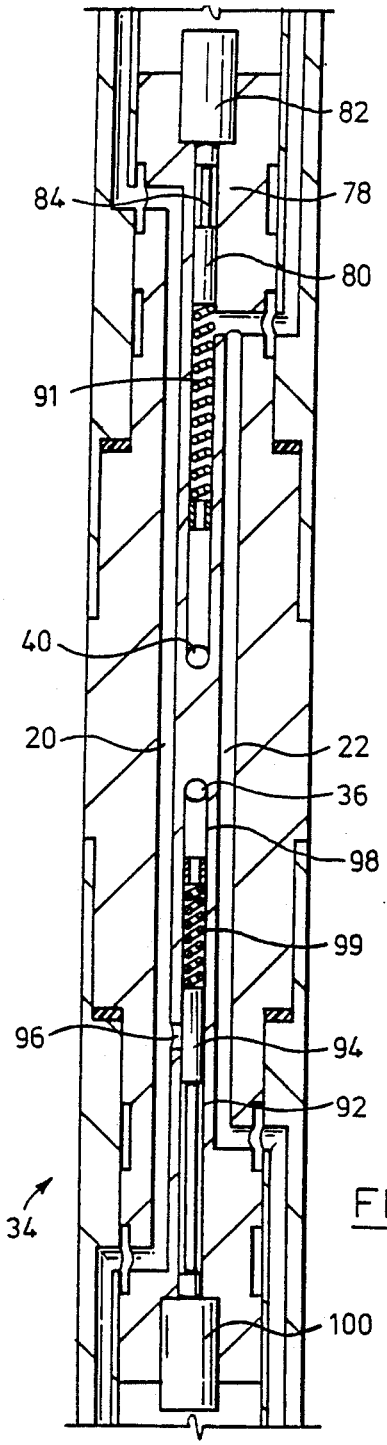
FIG. 6 is sectional view in a vertical plane illustrating pressure equalization and packer deflation valves associated with the drill stem testing system.
Figure 7:
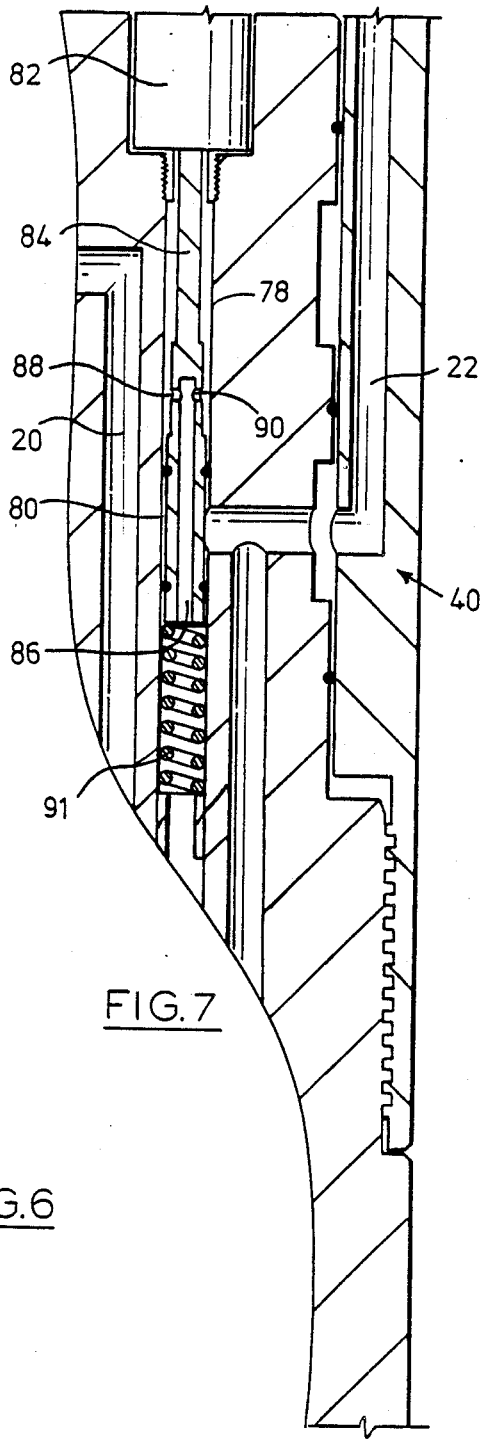
FIG. 7 is a further enlarged fragmented sectional view taken from FIG. 6 and better illustrating the construction of the pressure equalization valve.

The pressure equalizing and packer deflation valves are illustrated in FIG. 6. The pressure equalizing valve 38 has an elongate valve chamber 78 which places the pressure equalizing channel 22 in communication with the test region 18 through the port 40 formed in the exterior of the drill stem housing 12. A cylindrical valve member 80 is mounted for axial movement in the chamber 78, and carries O-rings which seal the valve member 80 to the chamber walls to prevent fluid bypass. A solenoid 82 is coupled by an extension arm 84 to the valve member 80 and can be actuated to retract the valve member 80 from a pressure equalizing position (as in FIG. 5) in which fluids can flow between the equalizing channel and the port 40 to an isolating position (as in FIG. 6) in which the passage of fluids is obstructed thereby isolating the test region 18 from the upper and lower wellbore regions 24, 26. The valve member 80 has a central passage 86, and two minor transverse passages 88, 90 which extend between the central passage 86 and the valve chamber region adjacent the solenoid 82 to ensure that a pressure differential cannot be created axially along the valve member 80 that might potentially impede operation. A spring 91 mounted in the valve chamber 78 serves to bias the valve member 80 to the pressure equalizing position. This ensures that test results are not distorted by pressure applied to the test region 18 during packer inflation. A spring may alternatively be used to bias the valve member 80 normally to the isolating position, the solenoid 82 then being energized to move the valve member to the equalizing position, but such an arrangement is not preferred.

The packer deflation valve 34 is substantially identical to the pressure equalizing valve in structure and operation. The valve 34 includes a valve chamber 92 and a movable cylindrical valve member 94 sealed to chamber walls. The chamber 92 has an inlet 96 in communication with the high pressure channel 20, and an outlet 98 in communication with the discharge port 36. The valve member 94 moves between an inflate position (as in FIG. 6) in which fluid cannot escape from the high pressure channel to the discharge port 36 and a deflate position (not illustrated) in which the packers 14, 16 and high pressure channel 20 discharge through the discharge port 36 to the test region 18. A spring 99 biases the valve member 92 to a normally open discharge position. A solenoid 100 electrically powered from the power line 46 and selectively operable by means of the computer 64 must be actuated to displace the valve member 94 to the closed inflate position to permit and maintain packer inflation.

The test flow valve 42 is illustrated in the views of FIGS. 8–12. The test flow valve involves a unique operating principle: a large flow gating valve 102, actuated by application of pressure, controls test fluid flows through the housing inlet port 44, and a pressure gating valve 104 gates pressure from a high pressure source and a low pressure source (which serves as a sink for receiving fluids) to the flow gating valve 102, thereby controlling the state of the larger flow gating valve. The high pressure source in the present embodiment is the high pressure channel 20 which is subject to relatively high pump pressure (pressure greater than ambient hydrostatic pressure); however, the high pressure source may consist of a channel communicating with the wellbore, for example through the equalizing line, hydrostatic pressure of drill mud accumulated in the wellbore providing a high pressure head.

Figure 8:
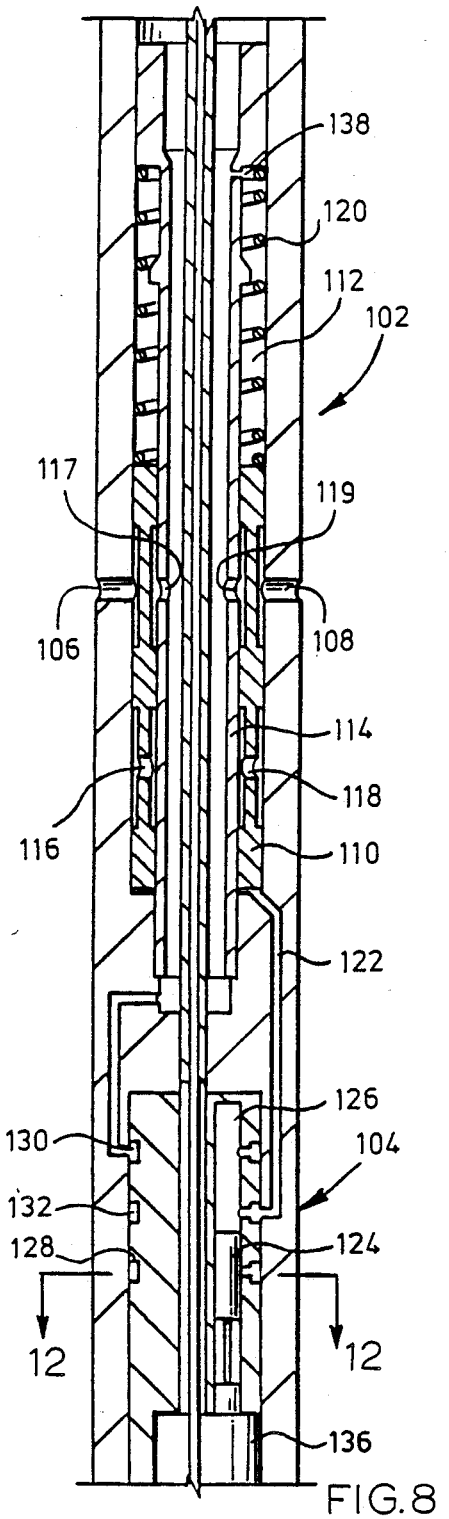
FIGS. 8 and 9 are sectional views in a vertical plane illustrating a test flow valve in closed and open positions, respectively.
Figure 9:
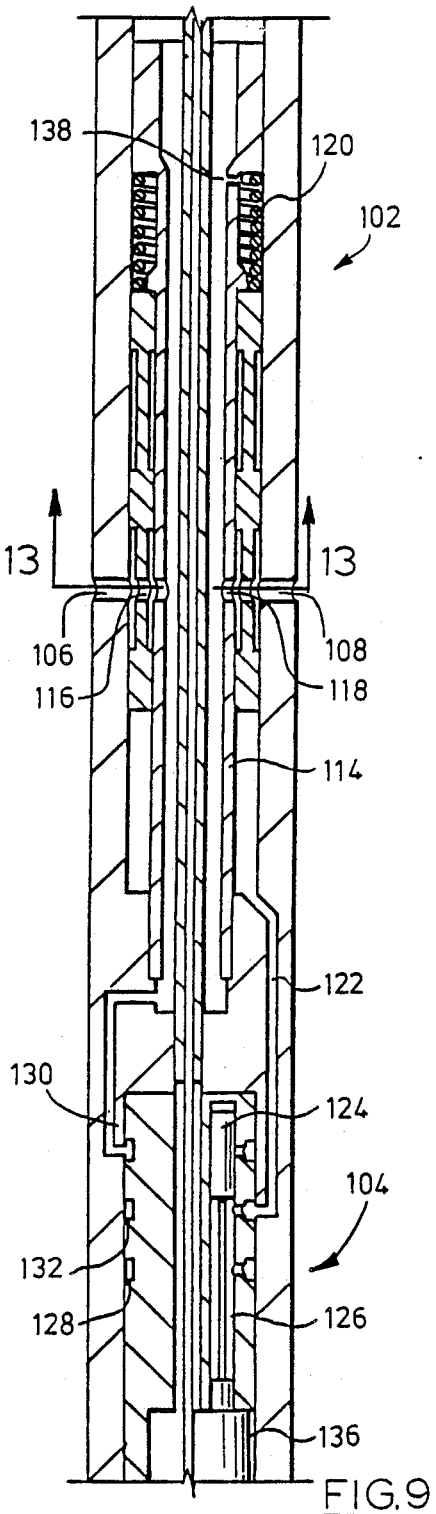
Figure 10:
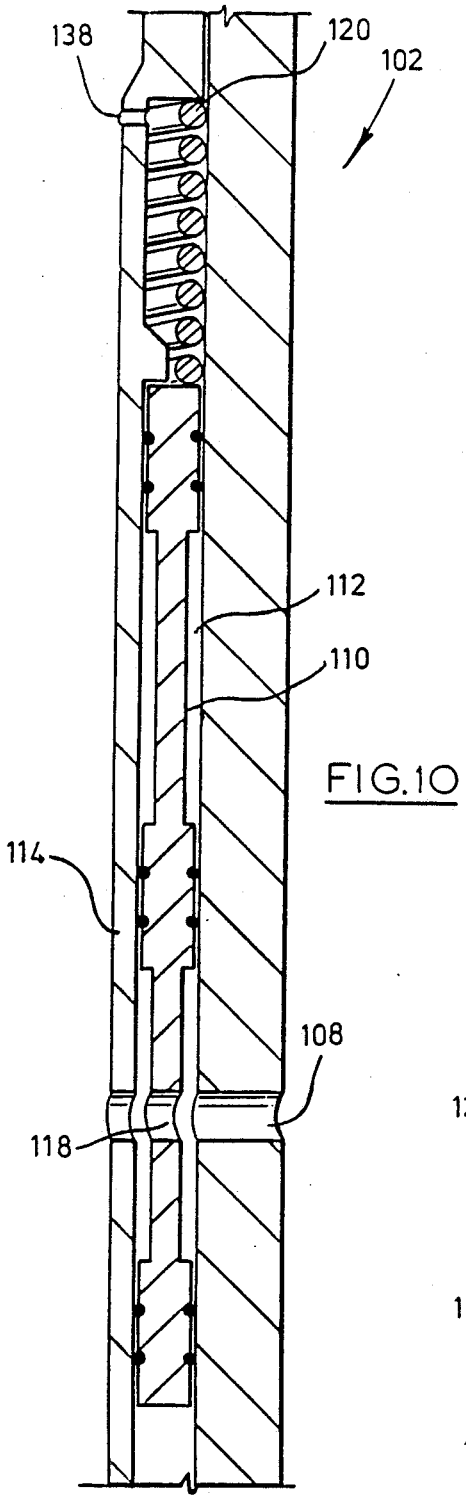
FIG. 10 is an enlarged sectional view of a portion of the test flow valve providing additional detail.

The flow gating valve 102 is illustrated in FIGS. 8 and 9, and additional detail is provided in the enlarged sectional view of FIG. 10. The housing inlet 44 which is schematically illustrated in FIG. 1 and which receives test fluid flows actually consists of two diametrically opposite openings 106,108 formed in the exterior of the drill stem housing 12. The flow gating valve 102 includes an flow gating valve member 110 of generally cylindrical shape which can slide axially in a valve chamber 112 defined by inner surfaces of the drill stem housing 12 and exterior surfaces of a cylindrical valve mandrel 114. The flow gating valve member 110 is sealed to these surfaces by means of O-rings. Two diametrically opposite openings 116, 118 formed in the flow gating valve member 110 permit fluid passage from the test region 18 through the housing openings 106, 108 and mandrel openings 117, 119 to the test flow channel 28. The two valve member openings 116, 118 are surrounded by an annular recess which facilitates the placing of the valve openings in communication with the housing openings. The flow gating valve member 110 is biased by a spring 120 to a closed position in which fluid flows from the test region 18 through the openings 106, 108 are obstructed. The flow gating valve member 110 can be displaced by application of relatively high pressure from the high pressure channel 20 through a pressure inlet channel 122 to the bottom of the valve member 110. When low pressure is applied, however, the biasing spring 120 cannot be overcome and the flow gating valve member 110 remains in a closed position.

Figure 11:
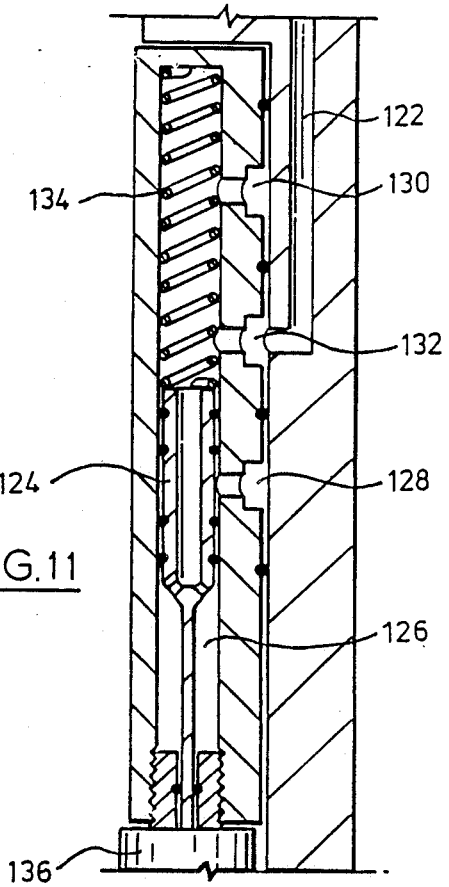
FIG. 11 is an enlarged section view of another portion of the test flow valve providing additional detail.
Figure 12:
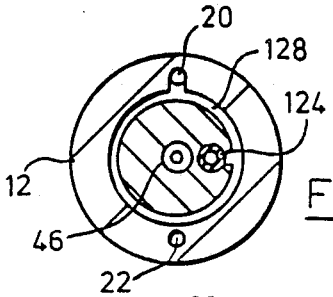
FIGS. 12 and 13 are cross-sectional views taken along lines 12—12 of FIG. 8 and 13—13 of FIG. 9 respectively, further detailing the structure associated with the test flow valve.
Figure 13:
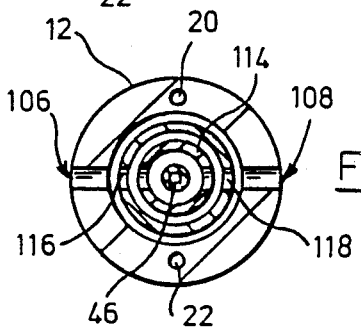

The general construction of the pressure gating valve 104 will be apparent from FIGS. 8 and 9, and further detail is provided in the views of FIGS. 10 and 11. The pressure gating valve 104 includes a cylindrical pressure valve member 124 which can be moved axially in a valve chamber 126. The valve chamber 126 has a number of annular ports; a high pressure port 128 which communicates with the high pressure channel 20; a low pressure port 130 which communicates with the interior of the test flow channel 28, and an outlet port 132 which communicates with the pressure inlet channel 122 associated with the chamber 112 associated with the flow gating valve member. The pressure valve member 124 is normally biased by a spring 134 to a low pressure position (as in FIG. 8) obstructing the passage of fluids from the high pressure port 128 to the outlet port 132, and placing the low pressure port 130 in communication with the outlet port 132. The pressure valve member 124 may be displaced by actuating a solenoid 136 to a high pressure position (as in FIG. 9) in which fluid flows between the low pressure port 130 and the outlet port 132 are obstructed, but fluids can pass between the high pressure port 128 and the outlet port 132. The solenoid 136 is of course actuated by means of the power line 46, switching unit 56 and computer 64. When the solenoid 136 is de-energized, the spring 134 restores the flow gating valve member to the closed position, displacing fluids from the valve chamber 112, the test flow channel 28 serving as a low-pressure sink to absorb such fluids.

It should be noted that the valve chamber 112 associated with the flow gating valve member has an opening 138 at an upper end thereof communicating with the test flow channel 28. This ensures that a pressure differential cannot be created axially along the flow gating member valve member 110 that prevents restoration of the valve member 110 to the closed position once the pressure valve chamber 124 is in communication with the low pressure port 130.

The overall operation of the drill stem testing system is conventional and only a brief outline will be provided, the actual test procedure being within the knowledge of those skilled in drill stem testing. The drill stem testing system 10 is assembled at the top of the wellbore by lowering drill stem housing sections successively into the wellbore, screw fitting adjacent sections to one another. When the drill stem testing system 10 has been fully assembled in the wellbore, the drill pipe section 59 is then attached to the drill stem testing system 10, and further drill pipe sections are added until the drill stem testing system 10 is positioned at the region of interest. The external conduction line is then extended through the interior of the drill string to engage the overshot connector 60 with the male connector 58. The packer deflation valve 34 is then energized to an inflate position, and the pump 30 energized to inflate the packers 14, 16 isolating the test region. The pressure equalization valve 38 is then energized to a closed position to isolate the test region. The test flow valve 42 is then actuated to introduce fluid from the test region into the test flow channel 28, and pressure and temperature changes associated with the test flow are sensed and transmitted to the surface. The test flow valve 42 may be actuated several time to repeat the testing procedure. Once testing is complete, the pressure equalizing valve 38 is actuated from the surface to place the upper and lower bore regions 24, 26 in communication with the test region 18 for pressure equalization. The packer deflation valve 34 may then be electrically actuated to deflate the packers 14, 16 and the drill pipe and drill stem testing system 10, withdrawn from the wellbore.

It will be appreciated that a particular embodiment of the invention has been described and that modifications may be made therein without departing from the spirit of the invention or the scope of the appended claims.

As regards the transmission of power and data to and from the drill stem testing system 10, a number of alternatives within the scope of the present invention and claims are possible. For example, the switching unit 56 might be removed entirely and replaced with a switching unit located at the surface. In such circumstances, the conduction path containing the conductor C1 would no longer be used to deliver power to a single gating mechanism within the drill stem housing, namely, the switching unit 56, and the conduction path containing the conductor C6 would no longer be used to transmit switching control signals. Instead the conduction paths containing the conductors C2–C5 might receive power directly from the external conduction line for the operation of their associated device, the external power conduction line now having at least four distinct power conduction lines, one corresponding to each device to be electrically operated. Power flow may then be gated directly at the surface, between the various conductors associated with the external power conduction line, to individually actuate the test devices. Such an arrangement would eliminate the need for below-surface switches; however, a greater number of large-diameter conductors would be required within the external power conduction lines to avoid severe power losses of spans typically in the order of several thousand feet, and the cost of the external power line would accordingly be very expensive.

Alternatively, the common switching unit 56 may be eliminated, a single power conductor extended through both the external power conduction line and the internal power line, and each test-related device provided with its own distinct switch (in the drill stem housing) which regulates application of power from the common power conductor. Each such switch may be coupled to its own unique data line so that switching control signals can be transmitted from the surface, and the external power conduction line may in such circumstances be provided with four distinct data conductors. The four data conductors both in the external and internal power conduction lines could in a further modification be replaced by a single switching data transmission line if a signal multiplexing arrangement were incorporated.

I claim:

1. In a testing system for use in testing fluids in subsurface regions surrounding a wellbore, the testing system having an elongate housing insertable into the wellbore and a test flow channel formed in the housing for receiving test fluid from the test region and directing the test fluid through the interior of the housing, a test flow gating valve positioned in the test flow channel for regulating the flow of test fluid through the test flow channel, comprising:

means defining a test flow chamber in-line with the test flow channel;

a test flow valve member;

means mounting the test flow valve member in the test flow valve chamber for movement between an open position in which test fluids can flow through the test flow channel and a closed position in which test flow valve member obstructs the flow of fluids through the test flow channel;

biasing means for biasing the test flow valve member towards the closed position;

a fluid inlet channel formed in the housing and communicating with the exterior of the housing for receipt of wellbore fluid subject to ambient hydrostatic pressure and with the test flow valve member such that the ambient hydrostatic pressure can move the test flow valve member to the open position; and, electrically-operable pressure gating valve means associated with the fluid inlet channel for regulating the application of the wellbore fluid under pressure to the test flow valve member, the pressure gating valve means comprising a. means defining a pressure valve chamber, a high pressure port receiving the wellbore fluid subject to ambient hydrostatic pressure and communicating with the pressure valve chamber, a low pressure port communicating with the pressure valve chamber, and an outlet port for placing the pressure valve chamber in communication with the test flow valve member;

b. a pressure valve member;

c. means mounting the pressure valve member in the chamber for movement between a high pressure position in which the pressure valve member obstructs the low pressure port and places the high pressure port in communication with the outlet port and a low pressure position in which the pressure valve member obstructs the high pressure port and places the low pressure port in communication with the outlet port;

d. pressure valve biasing means for biasing the pressure gating valve member towards the low pressure position;

e. sink means for receiving wellbore fluid from the low pressure port; and, f. electrically-operable pressure valve displacing means for displacing the pressure valve member from the low pressure position to the high pressure position.

2. A testing systems as claimed in claim 1 in which the biasing means associated with the test flow valve member and the pressure valve biasing means are springs.

3. In a system for use in testing fluids in subsurface regions surrounding a wellbore, the testing system having an elongate housing insertable into the wellbore and a test flow channel formed in the housing for receiving test fluid from the test region and directing the test fluid through the interior of the housing, the improvement comprising:

expandable packer means mounted on the exterior of the housing for isolating the test region in the wellbore when fluid under pressure is applied to the packer means;

electrically-operable pump means located within the housing and in communication with the exterior of the housing for producing wellbore fluid under pressure;

high pressure channel means formed in the housing for placing the pump means in communication with the packer means such that the wellbore fluid under pressure can be applied to the packer means;

packer deflation valve means for discharging wellbore fluid from the packer means to the wellbore, the packer deflation valve means comprising means defining a deflation valve chamber, an inlet port placing the deflation valve chamber in communication with the high pressure channel means, and an outlet port placing the deflation valve chamber in communication with the exterior of the housing;

a deflation valve member;

means mounting the deflation valve member in the deflation valve chamber for movement between an inflate position in which the valve member obstructs the passage of fluids between the inlet port and the outlet port and a deflate position in which the pressure valve member permits the passage of fluids between the inlet port and the outlet port;

deflation valve biasing means for biasing the deflation valve member to the deflate position; and, electrically-operable deflation valve member displacing means for displacing the deflation valve member from the deflate position to the inflate position.

4. An improvement as claimed in claim 3 in which the deflation valve biasing means is a spring.

* * * * *